US006722064B2

(12) United States Patent
Knapp et al.

(10) Patent No.: US 6,722,064 B2
(45) Date of Patent: Apr. 20, 2004

(54) ACTIVE DISPLAY DEVICE

(76) Inventors: Albert F. Knapp, 401 Bernard Ave., Apartment #4, St. Henry, OH (US) 45883; Tammy W. Knapp, 401 Bernard Ave., Apartment #4, St. Henry, OH (US) 45883

( * ) Notice: Subject to any disclaimer, the term of this patent is extended or adjusted under 35 U.S.C. 154(b) by 43 days.

(21) Appl. No.: 10/123,219

(22) Filed: Apr. 17, 2002

(65) Prior Publication Data

US 2003/0196357 A1 Oct. 23, 2003

(51) Int. Cl.[7] ..... G09F 19/00
(52) U.S. Cl. ..... 40/410; 40/414
(58) Field of Search ..... 40/409, 410, 411, 40/414, 455, 906; 446/267

(56) References Cited

U.S. PATENT DOCUMENTS

| | | | | | |
|---|---|---|---|---|---|
| 2,859,020 | A | | 11/1958 | Eddy et al. | |
| 2,951,689 | A | | 9/1960 | Asp et al. | |
| 2,958,517 | A | | 11/1960 | Harker et al. | |
| 3,116,913 | A | | 1/1964 | Lane | |
| 3,425,157 | A | * | 2/1969 | Hartsock | 446/134 |
| 4,162,855 | A | | 7/1979 | Bender | |
| 4,490,931 | A | * | 1/1985 | Fleemin | 40/406 |
| 5,189,821 | A | | 3/1993 | Lee | |
| 5,313,727 | A | | 5/1994 | Murray, Jr. | |
| 5,435,086 | A | | 7/1995 | Huang | |
| 5,620,353 | A | | 4/1997 | Lai | |
| 5,666,750 | A | | 9/1997 | Segan et al. | |
| 5,711,099 | A | | 1/1998 | Nesbit et al. | |
| 5,743,780 | A | * | 4/1998 | Liu | 446/136 |
| 5,864,976 | A | | 2/1999 | Yang | |
| 5,906,105 | A | | 5/1999 | Ugolini | |
| 6,057,497 | A | * | 5/2000 | DeVivo | 84/95.2 |
| 6,132,284 | A | * | 10/2000 | Lin | 446/267 |
| 6,145,227 | A | * | 11/2000 | Liao | 40/406 |
| 6,145,277 | A | * | 11/2000 | Lawecki et al. | 53/428 |
| 6,282,820 | B1 | | 9/2001 | White et al. | |
| 6,334,270 | B1 | * | 1/2002 | Ko | 40/406 |
| 6,345,457 | B1 | | 2/2002 | Bradley | |
| 6,357,151 | B1 | * | 3/2002 | Yuen | 40/406 |
| 6,449,887 | B1 | * | 9/2002 | Song | 40/406 |
| 6,493,971 | B1 | * | 12/2002 | Yuen | 40/426 |
| 6,508,022 | B2 | * | 1/2003 | Huang | 40/426 |
| 2002/0000055 | A1 | | 1/2002 | Augsburger | |

* cited by examiner

*Primary Examiner*—Lesley D. Morris
(74) *Attorney, Agent, or Firm*—Richard C. Litman

(57) ABSTRACT

An active display device includes a motorized base and a transparent display. The base unit includes a magnetic drive, which communicates magnetically with a magnetically attractive rotor or agitator in the bottom of the display unit to circulate the fluid within the display unit and any particulate matter mixed therein. The purely magnetic communication between base and display eliminates all mechanical passages therebetween, thereby precluding potential leakage routes from the display component and permitting the display to be readily removed and replaced atop the base. The display may include a magnetically movable floor or other panel, if desired, with the floor panel disposed between the magnetic rotor and the display having a series of passages therethrough to permit liquid circulation, but precluding passage of particles beneath the floor to the rotor area. The base may include numerous additional features, such as an audio system, remote actuation, lighting, etc.

20 Claims, 4 Drawing Sheets

ACTIVE DISPLAY DEVICE

BACKGROUND OF THE INVENTION

1. Field of the Invention

The present invention relates generally to enclosed, three dimensional decorative displays, dioramas, and the like, and more specifically a "snow globe" type display including powered means for actively circulating the fluid and particulate matter therein. The present active display uses magnets to agitate the fluid, thus eliminating any possibility of leakage due to a rotary shaft penetrating the display chamber. This permits a modular configuration, with various display configurations being selectively installable upon a common base unit.

2. Description of the Related Art

The basic concept of the "snow globe," i.e., a three dimensional scene enclosed by a transparent dome and containing a liquid and some particulate matter to simulate snowflakes, etc., has been known for many years. Most such devices are passive, in that no action or movement of the display occurs while the device is at rest. A person must actively move the device, as by inverting it, to cause the particulate matter to drop to the inverted upper portion, whereupon turning the device upright allows the particles to fall, and resembling a snowfall or the like.

More recently, active devices have been developed in which an electric or other motor drives a fan, propeller, or the like to circulate a fluid within the globe, thereby actively moving the particulate matter (or in some cases, only a liquid, to simulate wave action) until motor operation is terminated. However, this additional complexity leads to certain potential problems, the greatest of which is the introduction of a shaft extending between the motor and the impeller or fan which is of course immersed within the liquid contained within the dome or globe. Over a period of time, seals along the shaft wear, causing the fluid within the dome to leak, usually contaminating the motor.

In order to overcome this potential problem, a few individual have applied the principle of magnetic actuation to such snow globe devices, in which a motor rotates a magnet in a base component, with the base magnet magnetically engaging a second magnet in the bottom of the display chamber. Rotation of the base magnet by the motor, causes the display chamber magnet to rotate as well, thereby agitating the fluid within the display chamber. No mechanical communication is required between the base and the display chamber, thereby eliminating any possibility of rotating shaft leaks, etc. This principle of operation was initially developed many years ago for use in the laboratory and in industry, for mixing and stirring chemicals, medicines, etc. in open containers, rather than for use in agitating a fluid within a closed container, as in the present active display device.

A universal characteristic of such industrial magnetic mixing devices is the desire to mix all materials within the container, uniformly and completely. However, in a decorative display device which includes particulate matter therein, it is not desirable to allow the particulate matter to pass through certain areas of the device. Depending upon the size and shape of the particles, they may possibly interfere with tolerances between stationary and moving parts, and in any event, a larger number of particles are required if some considerable percentage of those particles is disposed within the agitator or impeller area of the device, where they are not visible. Moreover, the magnetic stirrers and agitators used in industry are universally removable from the container, for cleaning and reuse of the container for different substances and batches. Similarly, the containers are universally removable from the actuator bases, as the base component with its motor drive and other structure is relatively costly in comparison to the cost of the containers which may be installed thereon.

While a relatively few snow globe type devices having magnetic actuation of the contents have been developed in the past, none have provided the benefits of modular construction, in which any one of a number of different display units may be interchangeably installed atop a single base unit as desired. Moreover, none have provided means for separating particulate matter from the fluid agitation area in a liquid filled display device, nor any means for rotating or otherwise moving the display within the globe while simultaneously agitating the fluid and particles therein.

The present invention responds to these deficiencies by providing an active display having motorized base component, with the motor driving a magnetic impeller. A magnetic rotor or actuator is provided within the lower portion of the permanently sealed display component, with the magnetic impeller within the base engaging the magnetic agitator or rotor in the bottom of the display unit. This permits the display unit to be separable from the relatively costly base unit with its motor drive, with the owner being free to interchange display units depending upon the season (e.g., fall scenes with particles resembling autumn leaves, winter snow globes, holiday scenes, etc.) as desired. The use of a single base unit enables the base to incorporate any of a number of additional devices, e.g., a clock, radio or other audio device, remote actuation, etc., as desired, without the consumer being required to purchase a relatively costly base component incorporating these features, for each display globe desired.

Moreover, the present active display device may include additional moving components within the display portion, as desired. The magnetic actuation may engage an additional magnet(s) within a rotatable display floor within the display globe, causing it to rotate simultaneously with fluid agitation and particle movement. Each of the embodiments of the present display device includes a perforated bottom plate or the like between the magnetic actuator or rotor and the display portion of the display component, which prevents passage of particulate matter into the concealed portion of the device where the magnetic rotor is contained.

A discussion of the related art of which the present inventors are aware, and its differences and distinctions from the present invention, is provided below.

U.S. Pat. No. 2,859,020 issued on Nov. 4, 1958 to William R. Eddy et al., titled "Magnetic Driven Collapsible Agitator Assembly," describes an industry or laboratory type system, employing a radially collapsible insert for removable installation within a bottle or other container having a relatively narrow neck. The Eddy et al. device teaches away from the present active display device, in that the Eddy et al. agitator is adapted for removable installation within an open container, rather than being permanently installed within a permanently sealed container, as in the present invention. Moreover, the environment of the Eddy et al. device is directed to a complete mixing of all materials within the container, and does not provide means for separating particulate matter from one area of the liquid container.

U.S. Pat. No. 2,951,689 issued on Sep. 6, 1960 to Howard L. Asp et al., titled "Magnetic Stirring Bar," describes a specifically shaped magnetic bar which may be dropped into an open liquid container, and which is rotated and agitated by a magnetic drive in a separate base unit. The Asp et al. magnet includes a larger diameter central structure which serves as a pivot on the bottom of the container, regardless of the orientation of the bar within the container. The Asp et al. magnet and its intended use teaches away from the present invention, as it is not desirable in industry to separate particulate and liquid elements during mixing.

U.S. Pat. No. 2,958,517 issued on Nov. 1, 1960 to Donald K. Harker et al., titled "Vessel For Tissue Culture And The Like Comprising A Magnetic Stirrer," describes a specialized container and magnetic stirrer element removably installable therein. While the Harker et al. container may be closed, it is not permanently sealed. Moreover, Harker et al. do not provide any means for separating any particulate matter within the container from the magnetic stirring element nor means for concealing the magnetic element from sight in an otherwise transparent container, which means are parts of the present active display device.

U.S. Pat. No. 3,116,913 issued on Jan. 7, 1964 to Kingdon Lane, titled "Liquid Agitating Apparatus," describes an assembly having a base with a magnetic rotor and a removable container in which a magnetic agitator may be removably placed. While the Lane container may be sealed, as is desirable in processing photographic film, the container teaches away from any permanent sealing means, unlike the present display device. No means for separating particulate matter from the magnetic stirring element nor for rotating a portion of the display within the container, is disclosed by Lane.

U.S. Pat. No. 4,162,855 issued on Jul. 31, 1979 to Charles E. Bender, titled "Magnetic Stirrer Apparatus," describes several embodiments of such an apparatus, incorporating a specially configured open container. The container includes a series of inwardly disposed ridges which engage a frame structure for the magnetic impeller, in order to keep the magnet impeller frame from rotating within the container. Another embodiment describes a collapsible device which may be removably installed through the neck of a narrow container. Bender does not disclose a permanently sealed container having a magnetic impeller permanently installed therein, nor does he disclose any means of keeping particulate matter separated from the impeller area of the container, which means are a part of the present display device. Moreover, Bender teaches away from one embodiment of the present invention, in that he provides means to keep a part of the structure from rotating, whereas in one embodiment of the present invention, a portion of the internal structure of the display is adapted to rotate by means of magnetic attraction to the magnetic rotor in the base.

U.S. Pat. No. 5,189,821 issued on Mar. 2, 1993 to Vincent K. W. Lee, titled "Liquid Wave Display Ornament," describes a display device having a transparent dome containing two liquids of different specific gravities from one another. A decorative article (e.g., small plastic boat model, etc.) is placed in the container and floats between the two liquids. A magnetic actuator comprising a pair of axially rotating arms, is located in the base of the device. Rotation of the actuator arms periodically attracts and repels a diaphragm in the base of the display portion, causing it to rock and impart motion to the liquids in the display portion of the device. The Lee ornament is not modular, and the display portion cannot be separated from the base. Moreover, no means of rotating any portion of the display nor of separating particulate matter from the actuator in the display, is provided by Lee.

U.S. Pat. No. 5,313,727 issued on May 24, 1994 to Joseph E. Murray, Jr., titled "Decorative Kinetic Device," describes various embodiments of an active "snow globe" type device, incorporating a wind-up motor in its base. The motor operates a shaft which extends upwardly from the base and into the bottom of the fluid chamber to rotate a centrifugal impeller, rather than using the magnetic fluid movement means of the present invention. The potential problem with leakage along the shaft, has been noted further above. This also requires that the base and the viewing globe portions be permanently affixed together; they cannot be separated from one another, as can the corresponding components of the present display device. The impeller circulates the fluid and entrained particles through a vertical riser tube, where the fluid and particles exit, with the particles falling from the riser tube adjacent the top of the transparent dome. This system requires that the particles be mixed completely with the fluid and pass through the impeller to the riser tube; they cannot be separated from the impeller means, as in the present invention. Moreover, the riser tube provides a relatively directional flow, rather than allowing the particles to circulate randomly through the interior of the globe, and detracts from the view of the interior from certain directions. The rotary shaft extends upwardly into the visible portion of the chamber, where it can rotate or oscillate a display article therein, rather than using magnetic means to move the display, as in the present invention.

U.S. Pat. No. 5,435,086 issued on Jul. 25, 1995 to Jer-Fu Huang, titled "Revolving And Self-Rotating Liquid-Containing Decoration," describes a magnetically driven display wherein a generally horizontal arm having magnets at each end thereof, rotates within the base portion of the device. A magnetic disk containing a display article (doll, etc.) thereon is placed within the display chamber, which is filled with liquid. Rotation of the driving magnets causes the magnetic disk and display article thereon, to rotate about the interior of the display chamber. No particulate matter is described by Huang in his decorative device, and Huang accordingly does not provide any means of circulating the fluid within the display, other than by the motion of the display article being moved around the interior of the display chamber.

U.S. Pat. No. 5,620,353 issued on Apr. 15, 1997 to Tong-Kwung Lai, titled "Liquid Ball Capable of Providing A Dynamic View," describes a motorized device incorporating a magnetic coupling between the drive in the base of the device, and a display article in the liquid filled upper portion of the device. No particulate matter nor means for circulating such particles through the interior of the upper portion, is disclosed by Lai. However, Lai uses a gear train to rotate various levels of the device, including the upper transparent display dome, relative to one another. This requires that the various components of the device be permanently affixed to one another. The display portion cannot be removed or interchanged with another display upon the same base component, as can the displays of the present display device.

U.S. Pat. No. 5,666,750 issued on Sep. 16, 1997 to Marc H. Segan et al., titled "Decorative Article With Flake Circulating Means," describes a complex, gear driven device having a generally vertically oriented hollow, liquid filled disc with particulate matter therein. The disc is disposed at the back of the display globe, and is rotated by the gear train to circulate the liquid and particulate matter, in order to have the appearance of snow falling in the background of the scene within the globe. The gear train also rotates the scene within the globe. Segan et al. do not use any magnetic means to drive any of the components of their device, and the construction of the device does not permit viewing of the interior from all directions, whereas the present display device enables the viewer to see the interior from any direction therearound. Moreover, the base and display components of the Segan et al. device are permanently affixed together, and cannot be separated as modular units, as can the present device.

U.S. Pat. No. 5,711,099 issued on Jan. 27, 1998 to Mark S. Nesbit et al., titled "Snow Globe," describes a device having a liquid filled upper portion with a motor in the base to circulate the liquid. The liquid includes particles therein, to simulate snowflakes. The motor drive shaft extends upwardly through the base and into the bottom of the fluid filled chamber, where it rotates a propeller to drive the fluid and particles; no magnetic drive means is disclosed. Moreover, the particles are free to circulate through the propeller area, unlike the present invention where they are restricted from passing through the drive area.

U.S. Pat. No. 5,864,976 issued on Feb. 2, 1999 to Shin-Ya Yang, titled "Driving Mechanism Of Music Snow Drop Ball," describes a snow globe type device having the liquid and particulate matter therein circulated by an impeller powered by an electric motor installed in the base of the assembly. Yang recognizes the problems with mechanical shafts extending upwardly into a liquid filled container, and accordingly, the point of the Yang disclosure is the means used to seal the shaft to preclude liquid leakage downwardly into the working mechanism. The magnetic operation of the present device obviates any such concerns. Moreover, the present magnetic operating system permits a modular configuration, which cannot be achieved by the Yang assembly. Yang does not disclose any rotation means for the scenery within the globe, nor does he provide any means for preventing circulation of the particles through the drive area for the device.

U.S. Pat. No. 5,906,105 issued on May 25, 1999 to Giancarlo Ugolini, titled "Machine For Producing Frozen Beverages," describes a mixing device having an impeller which is magnetically coupled to a drive motor on the outside of the tank. Two different embodiments are disclosed, with one having the drive and driven elements disposed axially to one another, and the other having the drive elements disposed radially to one another on opposite sides of the tank wall, with the tank wall configured to conform to the space between the drive and driven elements. No permanently closed display, modular assembly, nor means for rotating another component above the rotating mixer paddle, is disclosed by Ugolini.

U.S. Pat. No. 6,282,820 issued on Sep. 4, 2001 to Michael L. White et al., titled "Circulating Fluid Amusement Device," describes a liquid filled "snow globe" type device, with the globe including a plurality of small particles therein as well. The base of the device includes a motor which drives a magnetic rotor, with the bottom portion of the globe including a magnetic impeller which is driven by the rotor in the base. The magnetic impeller circulates the liquid and particles through the globe. The White et al. device is not modular; the globe is permanently affixed to the base, and cannot be removed and interchanged for a different globe, as provided by the present invention. Moreover, White et al. do not provide any means of rotating the scene within the globe nor for separating the particles from the drive impeller, each of which features are provided by the present invention.

U.S. Pat. No. 6,345,457 issued on Feb. 12, 2002 to Wiliam P. Bradley, titled "Decorative Article For Simulating A Snow Scene," describes a device having a transparent upper case with a figure (snowman, etc.) therein. The case is open to the ambient environment by one or more vents provided in the top panel thereof. Internal lighting is provided for the figure within the case, with corresponding wiring penetrating the wall and extending from the case. An electric motor is installed beneath the figure, and circulates air and small particles through the case to simulate a snow scene. While a screen is provided over the motor fan, the screen does not prevent the particles from passing below the floor of the scene, as does the perforated panel of the present device.

Finally, U.S. Patent Publication Ser. No. 2002/000,055 published on Jan. 3, 2002 to Samuel F. Augsburger, titled "Magnetic Propulsion Decorative Device," describes a snow globe type device in which a magnet is placed upon the floor of the globe, internally within the globe. Operation of a motor beneath the floor of the globe moves a magnet attached thereto, which in turn causes the free magnet within the globe to move. Movement of the magnet within the globe, stirs the particles therein to create the effect of a snowfall. Augsburger makes no statement that his device is modular, as is the present display device. Moreover, Augsburger does not provide any movement of any decorative components or scenery within the globe of his device, and does not provide any separation between the stirring or agitation magnet (the magnet within the globe) and the particulate matter within the globe.

None of the above inventions and patents, taken either singularly or in combination, is seen to describe the instant invention as claimed. Thus an active display device solving the aforementioned problems is desired.

SUMMARY OF THE INVENTION

The present invention comprises an active display device, in which particulate matter carried in a liquid, is circulated within a transparent container to simulate a winter snowfall or other scene. The present display device utilizes a motorized base driving a magnet and a magnetically attractive component in the bottom of the display, to agitate the liquid and particles therein.

This mechanism allows the display dome to be completely sealed, with no shafts, wiring, or other mechanical penetration of the device, thereby greatly reducing the likelihood of any leakage of the display component. This configuration also allows different displays to be placed interchangeably atop a single motorized base unit, allowing the owner of the device to select different displays for different holidays, occasions, or seasons of the year as desired. Moreover, the magnetic drive system of the present invention may be used to rotate a moving display floor or the like within the display portion of the assembly, if so desired, in addition to circulating and agitating the fluid therein. A stationary perforated plate is installed above the magnet within the bottom of the display (and beneath the display floor, if installed), with the perforated plate permitting circulation of the liquid driven by the magnetic actuator or rotor in the bottom of the display unit, while keeping particulate matter from passing beneath the bottom plate and interfering with the magnetic rotor of the agitating system.

As the single base of the device may drive any one of a number of different displays, the purchaser of the present display device need only purchase a single base unit and purchase display units for removable placement atop the base unit as desired. The base unit may thus include a variety of additional features and functions (e.g., radio, tape and/or CD player, remote actuation, etc.), as these features and functions need be purchased only once, when the single base unit is purchased.

Accordingly, it is a principal object of the invention to provide an active display device comprising a transparent, liquid filled display unit containing freely moving particulate matter within the liquid, and automated means for circulating the fluid and particulate matter within the display.

It is another object of the invention to provide such an active display device including magnetic means for circulating the fluid, with a drive motor contained within a separate base unit and magnetic rotor or agitator contained within the display unit, with the display unit being removable from the base unit and with no mechanical interconnection between the two components.

It is a further object of the invention to provide such an active display device including means for precluding passage of the particulate matter directly through the area of the rotor or agitator disposed within the bottom of the display unit.

Still another object of the invention is to provide means for magnetically moving a panel within the display unit, by driving the panel magnetically from a magnetic actuator within the base component.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is an active display device, similar to the "snow globe" principle wherein a number of particles is contained in a liquid filled transparent globe. Shaking or inverting the globe stirs the particles, which float down through the liquid to resemble a snowfall. The present display device goes beyond the above simple concept, by motorizing the device to provide continuous operation. The magnetic actuation of the actuator within the bottom of the display unit provides complete sealing of the unit, with no passages for actuation shafts, wiring, etc. through any of the walls of the display unit, thereby greatly reducing the chance of any leakage.

Figure 1:
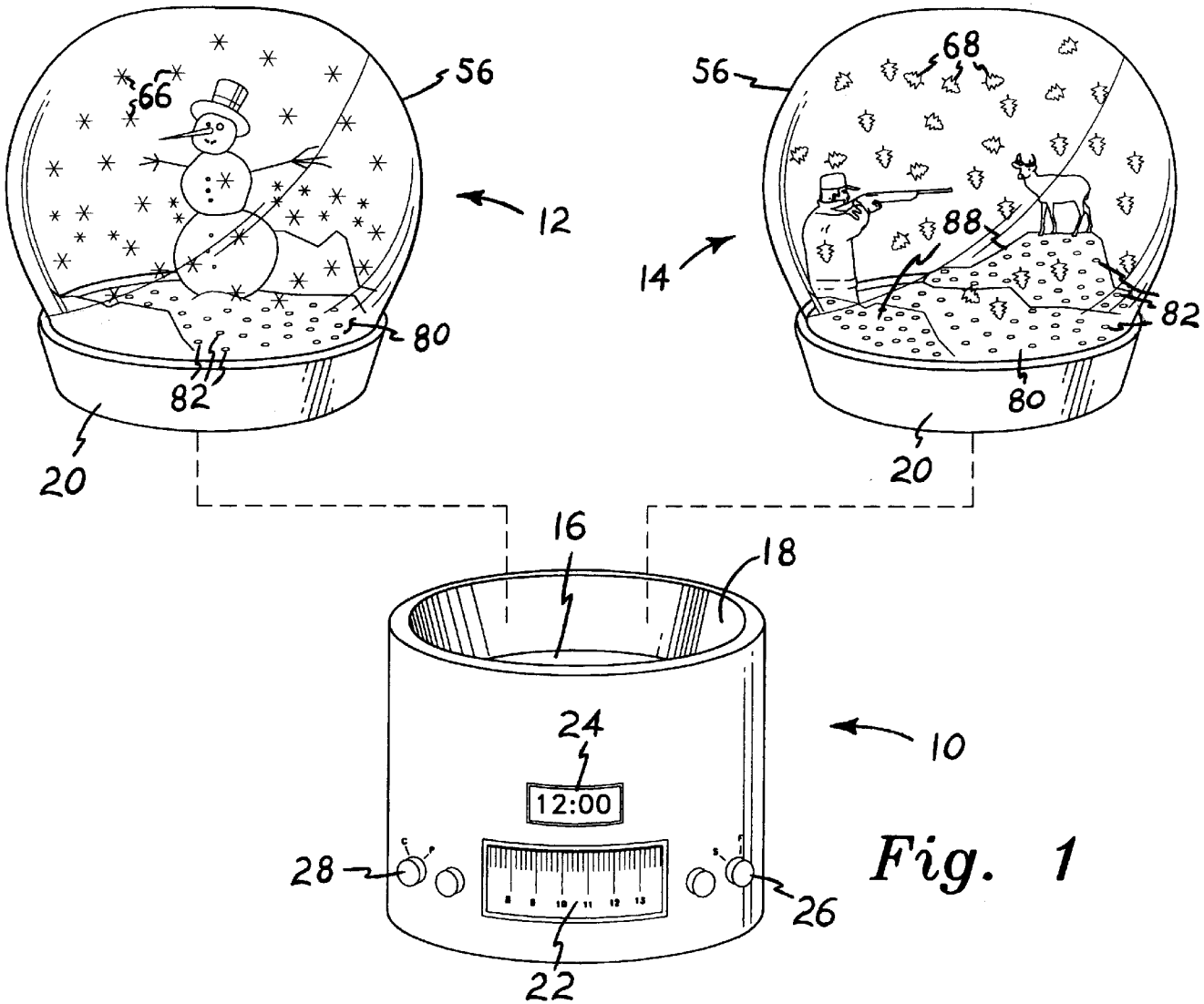
FIG. 1 is an exploded perspective view of an active display device according to the present invention, showing the interchangeability of display units atop a single base unit as well as other features.

FIG. 1 provides an exploded perspective view of a first embodiment of the present display device, having a single base unit 10 and a pair of interchangeable display units 12 and 14. The magnetic actuation of the display precludes any shafts, wiring, etc. between the base 10 and a corresponding display unit, thereby allowing the displays to be interchanged freely as desired atop the base 10. The base 10 has a receptacle 16 with tapered sides 18, with the displays, e.g. units 12 and 14, having correspondingly tapered side walls 20 to fit closely within the receptacle 16 of the base unit 10. The displays may include different scenes, e.g. the winter snowman scene of the left side display unit 12 in FIG. 1 and the fall hunting scene of the right side display unit 14 of FIG. 1, which may be placed atop the single base unit 10 as desired, depending upon the season, occasion, holiday, etc.

The interchangeability of the various display units, e.g. units 12 and 14, etc., atop the single base unit 10, enables a person purchasing the present display device to purchase only a single base unit 10, with its relatively costly drive motor and perhaps additional componentry therein. Yet, the displays may be changed as desired relatively economically, as the only additional component within the display units is a magnetic actuator (shown in FIG. 2) which communicates magnetically with the motor driven magnetic rotor (shown in FIG. 2) of the base unit 10. Thus, the base 10 may be provided with a number of additional features, e.g., a conventional radio or other audio system 22, a conventional digital or other type of clock 24, a speed control 26 using a conventional rheostat circuit, a switch 28 for continuous or intermittent operation using a conventional timer device, etc.

Figure 2:
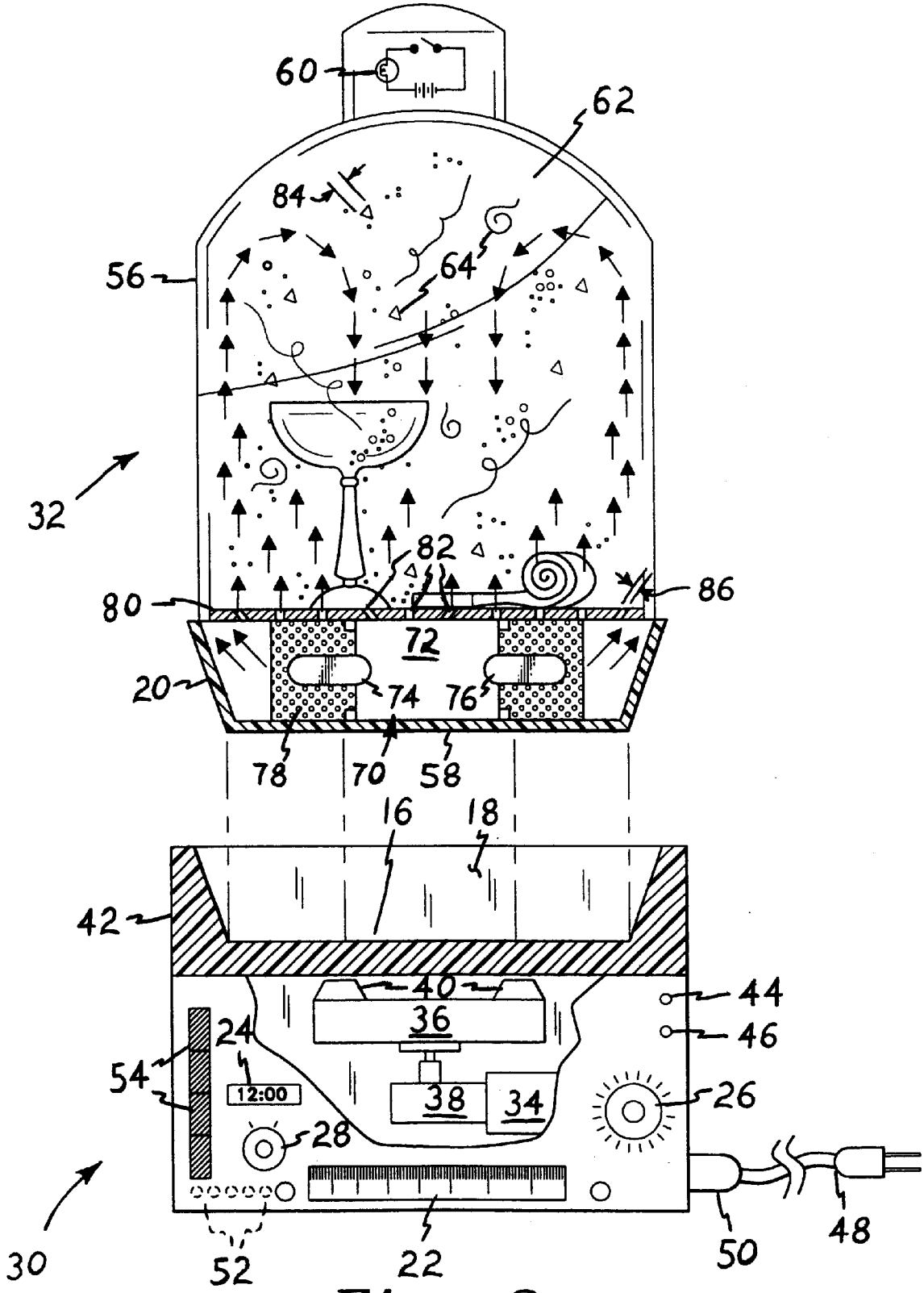
FIG. 2 is an exploded elevation view in section illustrating an exemplary display unit and base unit, and the functional features and components thereof.

FIG. 2 provides an exploded view in section of another embodiment of the base unit, indicated as base unit 30, and another display unit embodiment 32. The internal drive components of both the base unit 30 and the display unit 32 are essentially identical for all of the embodiments of the present invention, and thus need only be illustrated in FIG. 2 (with a variation on the display unit being shown in section in FIG. 3, and discussed further below). A drive motor 34 (preferably electric, although other principles, e.g. mechanical wind up devices, etc. may be used) is installed in the base 30, and rotates a magnetic impeller 36 by means of a gear reduction system 38. The impeller 36 may comprise a bar magnet, or may alternatively have separate magnets 40 at each end thereof.

The motor and rotary magnet impeller assembly 34 through 40 is concealed beneath a top panel 42 over the base unit 30. The top panel 42 includes the receptacle 16 and tapered side wall(s) 18 for seating the tapered bottom walls 20 of the display unit 32, or other correspondingly shaped display component bottom therein. The base unit 30 may be equipped similarly to the base unit 10 shown in FIG. 1, with a conventional audio system 22 (e.g., radio, tape and/or CD player, etc.), clock 24, speed and intermittent or continuous operation controls, respectively 26 and 28, etc. built into the base unit 30 as desired. The base unit 30 (or other base unit) may also include conventional remotely actuated sensors for operation, e.g. an infrared or other type of motion detector 44 and/or a sound detector 46 to initiate operation upon detecting motion or sound (general or specific) in the area. Such devices are well known and easily incorporated with the present device.

Electrical power for the present display device may be provided by a conventional electrical cord 48 which may have a base unit connector plug 50 for removable attachment to the device. Alternatively, a series of electrical storage batteries 52 may be installed within the base unit 30 of the device, and/or solar cells 54 may be provided to generate the required electrical energy. While these electrical power supply components are only shown in FIG. 2 for the base unit 30, it will be understood that they may be adapted to the base component 10 of FIG. 1 and/or any other base component comprising a part of the present display device invention, as desired.

The display unit 32 (and others) essentially comprises a hollow, transparent (glass, acrylic, etc.) dome or shell 56 which is sealed to or formed integrally with a bottom panel 58. The panel 58 includes tapered side wall(s) 20 for seating securely within the corresponding tapered receptacle 16 of the base unit 30 (or other base unit). The assembly of the transparent shell 56 and bottom panel 58 form a sealed unit which is devoid of any passages therethrough. A light circuit 60 comprising a battery, light, and switch may be installed atop the dome or shell 56 if so desired, with further remote or automated actuation means (e.g., similar to the remote sound actuation means 46 shown in the base unit 30) being provided in lieu of a manually actuated switch, if desired.

A liquid 62 (water, oil, etc.) fills the display unit 32, as well as the display units 12 and 14 of FIG. 1 and other display units of the present invention. A plurality of particles 64 is disposed within the liquid 62, with the particles 64 preferably having a specific gravity slightly greater than that of the liquid 62 with which the display unit is filled. The various display units of the present invention may incorporate different themes, as noted further above. For example, the display unit 32 of FIG. 2 may comprise a party scene, with particles 64 resembling confetti, streamers or ribbons. In FIG. 1, the particles 66 of the winter scene display 12 resemble snowflakes, while the autumn scene in the display 14 contains particles 68 resembling autumn leaves. The specific configuration of the particles (other than their size, as discussed further below) is not critical to the present invention.

The bottom portion of the display unit 32 (as well as the other display units 12, 14, etc. of the present invention) includes a magnetically attractive actuator 70 therein. The magnetic actuator 70 comprises a central rotor or wheel 72, with a pair of opposed magnetically attractive elements 74 and 76 extending radially therefrom. The magnetically attractive elements may comprise magnets, or perhaps soft iron or other ferrous metal components which are magnetically attracted to and magnetically engage the magnets 36 and/or 40 of the base unit 30. Alternatively, the base unit 30 may contain a soft iron or other ferrous metal impeller, with the magnetically attractive elements 74 and 76 of the display unit 32 comprising magnets. Preferably, both the impeller of the base unit 30 and the actuator 70 of the display unit are magnets, in order to provide a stronger magnetic coupling between the two.

The magnetically attractive elements 74 and 76 of the display unit are preferably coated (plasticized, etc.) to prevent the ferrous metal content of the elements 74 and 76 from rusting, particularly when the liquid 62 of the display unit comprises water. A porous, toroidal retainer or screen 78 may be installed in the bottom portion of the display unit 32 to hold the magnetic attractive actuator 70 in place. The central rotor or wheel 72 with its attached magnetically attractive elements 74 and 76 rotates within the retainer 78 to stir and circulate the liquid 62 within the display unit 32, due to magnetic coupling with the magnetic drive 36 as it rotates in the base unit 30.

A porous plate 80 is installed in the lower portion of the display unit 32, just above the magnetic actuator 70. The plate 80 serves to conceal the magnetic actuator 70 from view through the transparent dome or shell 56 of the display unit 32. The plate 80 includes a plurality of liquid passages or holes 82 therethrough, which allow the liquid 62 within the display unit 32 to circulate past the vanes or blades of the magnetic actuator 70 as it rotates or spins, with the liquid circulation passing through the porous retainer 78 and through the passages 82 of the plate 80, thereby stirring and circulating the particles 64 contained within the display unit 32.

It will be noted that the various particles 64 contained within the display dome 56, has a minimum width 84 which is at least somewhat larger than the maximum width or diameter 86 of the passages 82 through the porous plate 80. (The passages 82 may be at any desired angle through the plate 80, to optimize liquid flow therethrough.) This precludes passage of any of the particles 64 below the plate 80, where they might otherwise interfere with the rotation of the magnetic actuator 70, and/or possibly cause the actuator 70 to jam by becoming interposed between the vanes or blades of the actuator 70 and the surrounding stationary structure. This also assures that all of the particulate matter 64 remains in the visible display area above the plate 80, thereby reducing the number of particles 64 required for the display from that which would be required if some of those particles were circulating below the plate 80 where they would not be visible.

Returning to FIG. 1, it will be noted that the porous plate 80 within the right side display unit 14 is non-planar, i.e., it includes relatively raised areas 88 thereon. These raised areas 88 may be molded, stamped or otherwise formed integrally as a single sheet of material with the plate 80 at the time of manufacture. These raised areas 88 serve to simulate hills and/or other uneven geographic terrain within the display scene of the display unit 14. It will be seen that such an uneven or non-planar plate may be formed in any practicable configuration, to simulate any desired surface, terrain, etc. as desired. Alternatively, the plate 80 may be formed as a primarily flat surface with one or more depressions therein, to simulate valleys, etc. It will be noted that the raised areas 88 may also include a series of liquid passages 82 therethrough, just as does the base portion of the plate 80.

Figure 3:
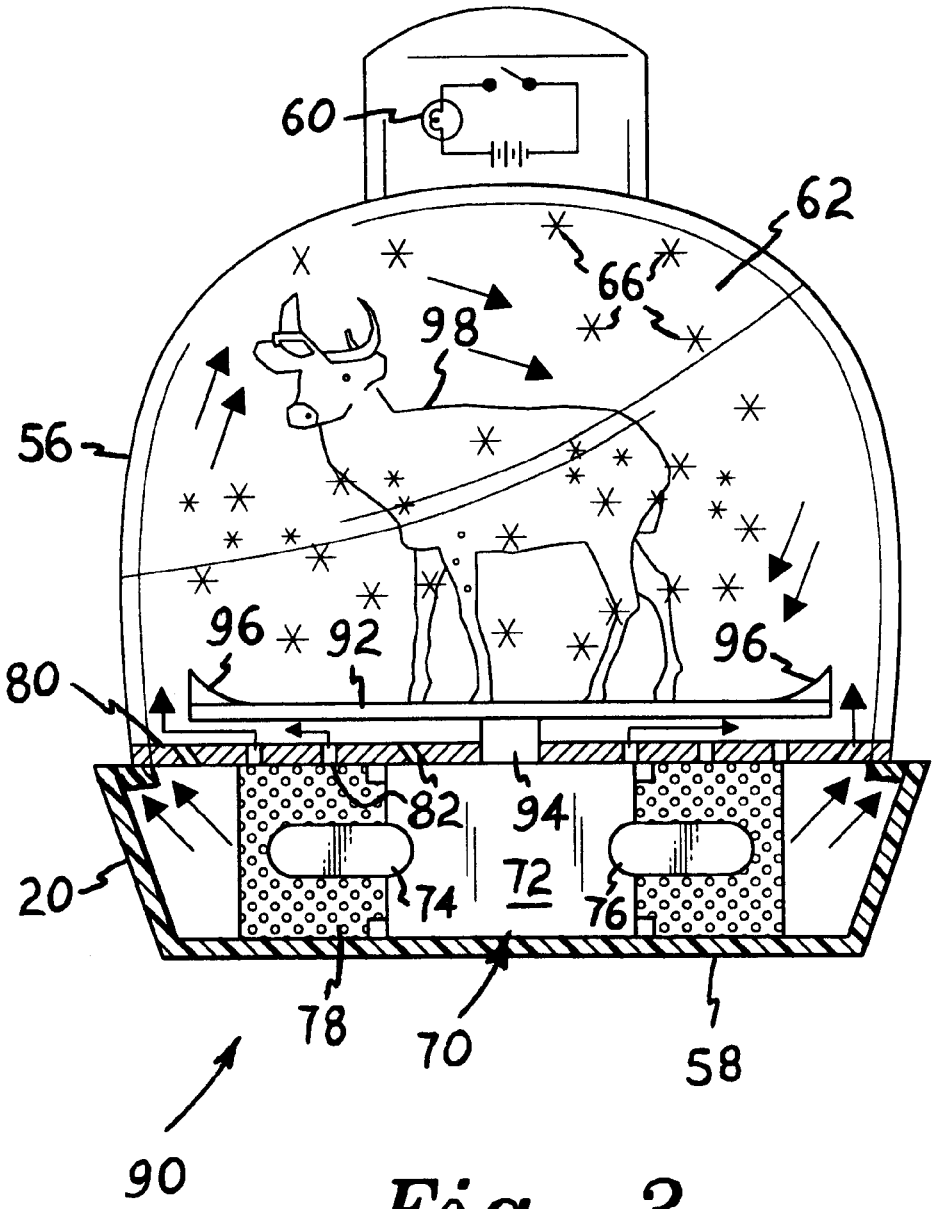
FIG. 3 is an elevation view in section of an alternative embodiment display unit, showing the means for magnetically rotating the display panel floor of the display therein.

FIG. 3 illustrates a further embodiment display unit of the present invention, designated as display unit 90. The display 90 includes a bottom panel 58 with an upwardly and outwardly tapering wall(s) 20 and a transparent display dome or shell 56 sealed thereto and containing a liquid 62 and particles 66 (or other particle types), as in the other display units of the present invention. A light system 60 may also be installed atop the shell 56. A magnetic actuator assembly 70 comprising an actuator wheel 72 with opposed magnetically attractive elements 74 and 76 extending therefrom and optional retainer 78 is installed above the bottom panel 58, with a porous plate 80 having liquid circulation passages 82 therethrough installed above the magnetic actuator 70.

The above described display 90 of FIG. 3 differs from other displays of the present invention in that it also has a movable display floor 92 above the stationary plate 80. The movable floor 92 is driven by a shaft 94 which extends upwardly from the magnetic actuator wheel 72 and through a passage in the plate 80. As the floor 92 is a rotating component, vanes 96, blades, or the like may be affixed to the floor 92 to assist in stirring or circulating the liquid 62 and particles 66 within the dome 56, if so desired. A solid display 98 may be placed atop the moving floor 92, or the floor 92 may be smaller, with a rotating display installed thereon and relatively fixed display components positioned therearound.

When the motor 34 is activated to rotate the magnetic impeller 36 within the base unit 30 (these components are illustrated in FIG. 1), the magnetic interaction between the impeller 36 and the magnetic actuator 70 causes the actuator 70 to rotate, thus also rotating the floor 92 by means of the shaft 94. It will be seen that the floor 92 may be provided with other than rotary motion, and/or may be offset from the center of the display and/or positioned in an area other than the bottom of the display, if so desired, by means of conventional shaft extensions, cams, levers, gears, etc. As the liquid within the display 90 circulates completely past the magnetic actuator assembly 70, through the passages 82 of the porous plate 80, and throughout the upper display portion of the display 90, it will be seen that no special sealing of the shaft 94 between the magnetic attractive actuator 70 and the rotating or moving floor 92 need be provided.

Figure 4A:
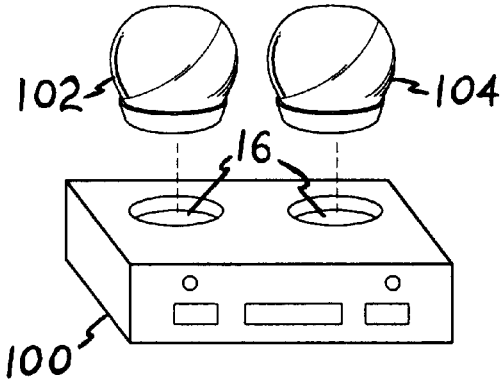
FIG. 4A is an exploded perspective view of an alternate embodiment of the present active display device, having a rectangular base with two generally hemispherical displays.
Figure 4B:
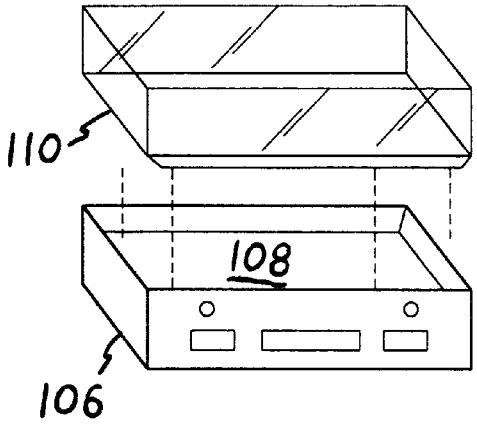
FIG. 4B is an exploded perspective view of another alternate embodiment of the present invention, having a rectangular base and corresponding display.
Figure 4C:
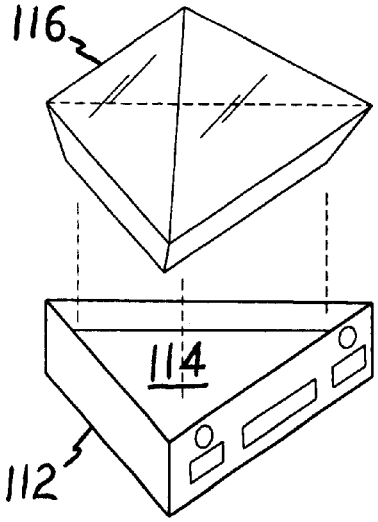
FIG. 4C is an exploded perspective view of yet another alternate embodiment of the present invention, having a triangular base and tetrahedral display.
Figure 4D:
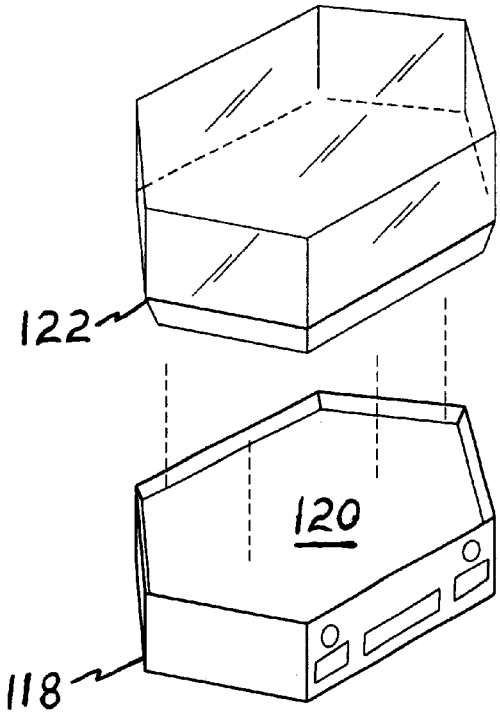
FIG. 4D is an exploded perspective view of a further alternate embodiment of the present invention, having a hexagonal base and corresponding display.

FIGS. 4A through 4C illustrate a few of the multitude of different geometric shapes and configurations which may be constructed for the present display. In FIG. 4A, a single, rectangular base unit 100 includes two display unit receptacles 16 therein, for selectively installing two different displays 102 and 104 (or other display units, as desired) therein. FIG. 4B illustrates a rectangular base unit 106 having a rectangular display receptacle 108 therein, to hold a similarly shaped display unit 110. In FIG. 4C, a triangular base unit 112 has a similarly shaped display receptacle 114, into which the similarly configured triangular bottom of a tetrahedral display unit 116 may be placed. FIG. 4D illustrates a base unit 118 having a hexagonal display receptacle 120 thereon, for holding the similarly shaped base of a hexagonal display unit 122. The various shapes and configurations illustrated in FIGS. 4A through 4D are exemplary, and it will be seen that any of a number of further shapes and configurations may be provided for the present display device.

In conclusion, the present active display device provides innumerable variations of shapes, configurations, display themes, and additional features in the basic invention comprising an active display scene having a powered base unit communicating magnetically to drive an interchangeably installable, sealed display unit. The provision of interchangeable displays enables a purchaser of the present display to purchase a single base unit, including various features therewith, and a series of different displays which may be interchangeably placed atop the base as desired.

The above described modular nature of the single base unit with its interchangeable displays, enables a number of relatively costly and complex features (e.g., conventional audio and video systems with integral and/or detachable speakers, clocks, timers and alarms, remote actuation, lighting, communications, weather stations, computer terminals and displays, etc.) to be incorporated in the single base unit. The consumer may then purchase additional relatively inexpensive display units for interchangeable installation atop the single base unit as desired, thereby precluding any requirement for the consumer to duplicate the features of the base unit in additional base units with their relatively high cost. The present invention will thus find favor with all who appreciate an attractive kinetic display and who have need or desire for additional devices incorporated therewith, and who appreciate the ability to change the display as the occasion warrants without need for duplication of the costly features in the base unit of the assembly.

It is to be understood that the present invention is not limited to the embodiments described above, but encompasses any and all embodiments within the scope of the following claims.

We claim:

1. An active display device, comprising:

a base;

a motor disposed within said base;

a magnetic impeller disposed within said base, and driven by said motor;

a top panel extending across said base, above said motor and said magnetic impeller;

a transparent display unit, comprising a sealed, hollow shell and devoid of passages therethrough;

a liquid disposed within said display unit;

a plurality of particles disposed within said liquid;

said display unit further including a bottom panel, for removably resting atop said top panel of said base;

a plate disposed within said display unit, above said bottom panel thereof;

said plate further including a plurality of liquid passages therethrough;

a magnetically attractive actuator disposed between said plate and said bottom panel of said display unit, and concealed from view by said plate;

a toroidal retainer disposed in proximity to said magnetically attractive actuator for holding said magnetically attractive actuator in place; and said magnetic impeller communicating magnetically with said magnetically attractive actuator, for selectively agitating said liquid and said particles within said display unit when said display unit is placed atop said base and said motor is actuated.

2. The active display device according to claim 1, wherein:

each of said particles has a minimum width; and each of said liquid passages of said plate has a maximum width smaller than said minimum width of each of said particles, for precluding passage of said particles beneath said plate and past said magnetically attractive actuator of said display unit.

3. The active display device according to claim 1, further including:

a display floor movably disposed within said display unit, above said plate thereof; and said magnetically attractive actuator selectively driving said display floor when said motor is actuated.

4. The active display device according to claim 1, wherein said plate has a non-planar configuration, for simulating uneven geographic terrain.

5. The active display device according to claim 1, further including an audio system disposed in said base.

6. The active display device according to claim 1, further including speed control means for said motor disposed in said base.

7. The active display device according to claim 1, wherein said motor disposed within said base comprises an electric motor.

8. An active display device, comprising:

a base;

a motor disposed within said base;

a magnetic impeller disposed within said base, and driven by said motor;

a transparent display unit;

a liquid disposed within said display unit;

a plurality of particles disposed within said liquid, with each of said particles having a minimum width;

said display unit further including a bottom panel;

a plate disposed within said display unit, above said bottom panel thereof;

a magnetically attractive actuator disposed between said plate and said bottom panel of said display unit;

a porous screen for positioning said magnetically attractive actuator;

said plate further including a plurality of liquid passages therethrough;

each of said liquid passages of said plate having a maximum width smaller than said minimum width of each of said particles, for precluding passage of said particles beneath said plate and past said magnetically attractive actuator; and said magnetic impeller communicating magnetically with said magnetically attractive actuator, for selectively agitating said liquid and said particles within said display unit when said motor is actuated.

9. The active display device according to claim 8, wherein:

said base and said display unit comprise two separate components; and said bottom panel of said display unit rests atop said top panel of said base when said display unit is placed atop said base.

10. The active display device according to claim 8, further including:

a display floor movably disposed within said display unit, above said plate thereof; and said magnetically attractive actuator selectively driving said display floor when said motor is actuated.

11. The active display device according to claim 8, wherein said plate has a non-planar configuration, for simulating uneven geographic terrain.

12. The active display device according to claim 8, further including an audio system disposed in said base.

13. The active display device according to claim 8, further including speed control means for said motor within said base.

14. The active display device according to claim 8, wherein said motor disposed within said base comprises an electric motor.

15. An active display device, comprising:

a base;

a motor disposed within said base;

a magnetic impeller disposed within said base, and driven by said motor;

a transparent display unit;

a liquid disposed within said display unit;

a plurality of particles disposed within said liquid;

said display unit further including a bottom panel;

a display floor movably disposed within said display unit, above said bottom panel thereof;

a magnetically attractive actuator disposed between said display floor and said bottom panel of said display unit, and selectively driving said display floor;

a toroidal screen surrounding and holding said magnetically attractive actuator for maintaining; and said magnetic impeller communicating magnetically with said magnetically attractive actuator, for selectively agitating said liquid and said particles and driving said display floor within said display unit when said said motor of said base is actuated.

16. The active display device according to claim 15, wherein:

said base and said display unit comprise two separate components; and said bottom panel of said display unit rests atop said top panel of said base when said display unit is placed atop said base.

17. The active display device according to claim 15, wherein:

each of said particles has a minimum width; and each of said liquid passages of said plate has a maximum width smaller than said minimum width of each of said particles, for precluding passage of said particles beneath said plate and past said magnetically attractive actuator of said display unit.

18. The active display device according to claim 15, wherein said plate has a non-planar configuration, for simulating uneven geographic terrain.

19. The active display device according to claim 15, further including an audio system disposed in said base.

20. The active display device according to claim 15, wherein:

said motor disposed within said base comprises an electric motor; and said base further includes speed control means for said motor.

* * * * *